US010961718B2

(12) United States Patent
Everhart, II et al.

(10) Patent No.: US 10,961,718 B2
(45) Date of Patent: Mar. 30, 2021

(54) CLADDING ELEMENT

(71) Applicant: James Hardie Technology Limited, Dublin (IE)

(72) Inventors: Robert Elliot Everhart, II, Lake Arrowhead, CA (US); Hui Li, Fontana, CA (US); Darren Southwell, Sydney (AU); Matthew Spencer, Palatine, IL (US)

(73) Assignee: James Hardie Technology Limited, Dublin (IE)

( * ) Notice: Subject to any disclaimer, the term of this patent is extended or adjusted under 35 U.S.C. 154(b) by 266 days.

(21) Appl. No.: 15/686,043

(22) Filed: Aug. 24, 2017

(65) Prior Publication Data

US 2017/0350138 A1 Dec. 7, 2017

Related U.S. Application Data

(62) Division of application No. 14/838,217, filed on Aug. 27, 2015, now Pat. No. 9,752,328.

(Continued)

(51) Int. Cl.
*E04F 13/08* (2006.01)
*E04F 13/14* (2006.01)

(52) U.S. Cl.
CPC ..... *E04F 13/0894* (2013.01); *E04F 13/0846* (2013.01); *E04F 13/148* (2013.01); *E04F 2201/026* (2013.01)

(58) Field of Classification Search
CPC ..... E04F 2201/01; E04F 2201/04; E04F 2201/045; E04F 2201/048; E04F 2201/026; E04F 2201/02; E04F 2201/022; E04F 2201/028; E04F 13/00; E04F 13/148; E04F 13/10; E04F 13/16; E04F 13/07; E04F 13/072; E04F 13/076; E04F 13/0894;

(Continued)

(56) References Cited

U.S. PATENT DOCUMENTS 294,855 A * 3/1884 Crawford
525,442 A 9/1894 Burrows (Continued)

FOREIGN PATENT DOCUMENTS

DE 3532112 3/1987
WO WO-2004081316 A1 * 9/2004 ..... E04F 15/02

OTHER PUBLICATIONS

Ready Pine Refinished Interior Tongue & Groove by Horizon Coatings, "The Original," http://www.readypine.com/About.htm, as printed Mar. 11, 2015 in 3 pages.

(Continued)

*Primary Examiner* — Jessica L Laux
(74) *Attorney, Agent, or Firm* — Knobbe Martens Olson & Bear, LLP

(57) ABSTRACT

A cladding element, for use in a building envelope, comprising a first face, a second face and a plurality of edges. One or more of the plurality of edges includes a mating feature configured to resist moisture passage between cladding elements when the cladding elements are installed on a wall or other structure. The cladding element can include one or more joint features to improve mating between the cladding elements, reduce labor costs, and facilitate moisture drainage from the cladding elements.

9 Claims, 19 Drawing Sheets

Related U.S. Application Data

(60) Provisional application No. 62/042,758, filed on Aug. 27, 2014.

(58) Field of Classification Search
CPC ... E04F 13/0846; E04F 13/08; E04F 13/0801; E04F 13/0817; E04F 13/0837; E04F 13/0844; E04F 13/085
USPC ..... 52/518, 526, 536, 539, 541, 547
See application file for complete search history.

(56) References Cited

U.S. PATENT DOCUMENTS 2,110,729 A * 3/1938 Hoggatt ..... E04F 13/10 52/448
2,758,044 A * 8/1956 Terry ..... E04F 15/022 428/535
4,955,169 A 9/1990 Shisko
5,016,416 A * 5/1991 Munk ..... B27N 5/00 428/218
8,387,327 B2 * 3/2013 Pervan ..... E04F 15/18 52/586.2
8,733,410 B2 * 5/2014 Pervan ..... B27F 1/02 144/347
8,745,952 B2 * 6/2014 Perra ..... E04F 15/02 52/588.1
D729,949 S 5/2015 Hartman et al.
9,140,018 B2 9/2015 Southwell
10,240,348 B2 * 3/2019 Pervan ..... E04B 5/00
2004/0206036 A1 10/2004 Pervan
2004/0231252 A1 * 11/2004 Benjamin ..... E04F 13/04 52/79.1
2010/0170182 A1 * 7/2010 Gately ..... E04F 13/0864 52/520
2011/0131901 A1 * 6/2011 Pervan ..... E04F 15/04 52/177
2011/0167744 A1 * 7/2011 Whispell ..... E04F 15/02 52/309.1
2011/0167750 A1 * 7/2011 Pervan ..... E04F 15/04 52/588.1
2012/0317909 A1 12/2012 MacKenzie
2013/0255174 A1 * 10/2013 Stafford ..... E04F 13/0894 52/539
2013/0283720 A1 * 10/2013 Pervan ..... E04F 13/0894 52/588.1
2013/0312356 A1 11/2013 Foral
2014/0215945 A1 * 8/2014 Swanson ..... E04B 1/64 52/302.1

OTHER PUBLICATIONS

Vintage Woodworks, "V-Groove Board," http://www.vintagewoodworks.com/v-groove.html as printed Mar. 11, 2015 in 2 pages.
Boral TruExterior Siding and Trim, http://www.boralamerica.com/TruExterior/truexterior-siding as printed Nov. 25, 2015 in 2 pages.

* cited by examiner

CLADDING ELEMENT

CROSS-REFERENCE TO RELATED APPLICATIONS

This application is a divisional of U.S. patent application Ser. No. 14/838,217, filed Aug. 27, 2015 and entitled CLADDING ELEMENT, which claims the benefit of U.S. Provisional Patent Application No. 62/042,758, filed Aug. 27, 2014 and entitled CLADDING ELEMENT, both of which are hereby incorporated by reference in their entirety and for all purposes.

BACKGROUND

Technical Field

The present disclosure relates to building elements suitable for use in construction. In particular the disclosure relates to cladding elements suitable for use in a building envelope.

The embodiments have been developed primarily for use as cladding elements and will be described hereinafter with reference to this application. However, it will be appreciated that the embodiments are not limited to this particular field of use and that the embodiments can be used in any suitable field of use known to the person skilled in the art.

Description of the Related Art

Any discussion of the prior art throughout the specification should in no way be considered as an admission that such prior art is widely known or forms part of the common general knowledge in the field.

Wood cladding elements are sometimes used to protect and/or improve the aesthetic qualities of walls and other structures. However, wood can be difficult and expensive to install and can have limited durability.

SUMMARY

It is an object of the present disclosure to overcome or ameliorate at least one of the disadvantages of the prior art, or to provide a useful alternative.

In some embodiments, a cladding element comprises a front face; a rear face opposite the front face; a first mating end; a second mating end opposite the first mating end; a first joint end; and a second joint end opposite the first joint end. In some embodiments, the cladding element includes a first mating feature on the first mating end. The first mating feature can comprise a recessed portion having a front recessed face. In some embodiments, the first mating features comprises a transition portion between the front recessed face and the front face. The first mating feature can include a first angled portion extending from the rear face. In some embodiments, the cladding element includes a second mating feature on the second mating end. The second mating feature can include a sloped portion extending from the front face toward the rear face and away from the first mating end. In some cases, the second mating feature includes a recess having a rear recessed face and a second sloped portion extending away from the first mating end and toward the rear face. In some embodiments, the sloped portion of the second mating feature and a transition portion of a first mating feature of a second cladding element form a groove when the cladding element is mated with a second cladding element.

In some embodiments, the groove has a V shape. In some cases, the sloped portion has a concave shape. In some embodiments, the groove has a cove shiplap shape. The cladding element can include a surface groove on the front face of the cladding element, the surface groove extending parallel to the first mating end. In some cases, the surface groove has substantially the same shape as the groove formed by the sloped portion of the second mating feature and the transition portion of the first mating feature of the second cladding element. In some embodiments, a gap is formed between the front recessed face of the first mating feature of the cladding element and a rear recessed face of a second mating feature of a second cladding element when the first mating feature of the cladding element is mated with the second mating feature of the second cladding element. In some cases, the gap is 0.06 inches.

According to some variants, a cladding element has a front face; a rear face opposite the front face; a first mating end; a second mating end opposite the first mating end; a first joint end; and a second joint end opposite the first joint end. The cladding element can include a first joint feature on the first joint end comprising a first joint face having a first sealing channel. In some embodiments, the cladding element includes a second joint feature on the second joint end comprising a second joint face having a second sealing channel. The cladding element can include a sealing element disposed within at least one of the first and second sealing channels.

In some embodiments, the sealing element is an elastomeric rod. In some cases, the first sealing channel extends along an entire length of the first joint end. In some embodiments, the first joint face is positioned at an offset angle from the rear face of the cladding element. In some cases, the offset angle is between 35 degrees and 55 degrees. In some embodiments, the first sealing channel extends through a first mating feature on the first mating end of the cladding element and through a second mating feature on the second mating end of the cladding element. In some cases, the first joint face extends over at least a portion of thickness of the cladding element between the front face and the rear face.

According to some variants, a cladding element includes a front face; a rear face opposite the front face; a first mating end; a second mating end opposite the first mating end; a first joint end; and a second joint end opposite the first joint end. In some embodiments, the cladding element includes a joint protrusion on and extending from the first joint end away from the second joint end. The cladding element can include a joint recess on the second joint end and configured to receive a joint protrusion on the first joint end of an adjacent cladding element.

In some embodiments, the joint protrusion includes a sealing channel in a surface of the joint protrusion. In some cases, the joint recess includes a sealing channel in a surface of the joint recess. In some embodiments, the cladding element includes a sealing element positioned in the sealing channel. In some cases, the sealing element is an elastomeric rod. In some embodiments, one of the rear face and the front face of the cladding element forms a surface of the joint protrusion. In some cases, the joint protrusion is positioned between and spaced from the front face and the rear face of the cladding element as measured perpendicular to the front face of the cladding element. In some embodiments, the joint protrusion extends in a direction parallel to the front face of the cladding element. In some cases, the joint protrusion extends through a first mating feature on the first mating end and through a second mating features on the second mating end of the cladding element.

According to some variants, a cladding system can include a plurality of cladding elements. The system can include first and second cladding elements constructed from fibre cement. Each of the first and second cladding elements can have a front face and a rear face opposite the front face. The elements can include a first mating edge between the front face and the rear face. In some embodiments, the elements include a second mating edge between the front face and the rear face, opposite the first mating edge. The elements can include a first mating structure on the first mating edge. The first mating structure can include a recessed portion having a front-facing surface set rearward from the front surface of the cladding element. The first mating structure can include a first angled portion extending rearward from the front face of the front surface of the cladding element and away from the second mating edge. In some embodiments, the first mating structure includes an offset portion extending between the first angled portion and the front-facing surface of the recessed portion. The first mating structure can include a second angled portion extending from the rear face of the cladding element toward the front face of the cladding element and away from the second mating edge. The elements can include a second mating structure on the second mating edge. The second mating structure can include a first angled portion extending from the front face of the cladding element toward the rear face of the cladding element and away from the first mating edge of the cladding element. In some embodiments, the second mating structure includes a recessed portion having a rear-facing surface set forward from the rear face of the cladding element. The second mating structure can include a second angled portion extending in a direction from the rear face of the cladding element toward the front face of the cladding element and toward the first mating edge of the cladding element. In some embodiments, the second mating structure includes an abutment face connecting the rear-facing surface of the recessed portion with the second angled portion. In some embodiments, the elements include a first joint end between the front face and the rear face. The elements can include a second joint end between the front face and the rear face, opposite the first joint end. In some embodiments, the first mating structure of the first cladding element is mated with the second mating structure of the second cladding element. In some embodiments, at least a portion of the second angled portion of the first mating structure of the first cladding element contacts at least a portion of the second angled portion of the second mating structure of the second cladding element. In some embodiments, the offset portion of the first mating structure of the first cladding element contacts at least a portion of the second mating structure of the second cladding element. In some embodiments, the front-facing surface of the recessed portion of the first mating structure of the first cladding element is spaced from the rear-facing surface of the recessed portion of the second mating structure of the second cladding element in a direction non-parallel to a plane of the front surface of the second cladding element.

In some configurations, the first angled portion of the first mating structure of the first cladding element and the first angled portion of the second mating feature of the second cladding element form a V-shaped groove.

In some configurations, the abutment face of the second cladding element is spaced from the first mating edge of the first cladding element.

In some embodiments, the system includes a third cladding element. The third cladding element can have a front face, a rear face opposite the front face, a first mating edge between the front face and the rear face, a second mating edge between the front face and the rear face, opposite the first mating edge, a first mating structure on the first mating edge, a second mating structure on the second mating edge, a first joint end between the front face and the rear face, and/or a second joint end between the front face and the rear face, opposite the first joint end. In some configurations, the first joint end of the first cladding element is mated with the second joint end of the third cladding element.

In some configurations, the first joint end of the first cladding element includes a joint recess and the second joint end of the third cladding element includes a joint protrusion. In some configurations, at least a portion of the joint protrusion of the third cladding element is received in the joint recess of the first cladding element.

BRIEF DESCRIPTION OF THE DRAWINGS

The embodiments will now be described more particularly with reference to the accompanying drawings, which show by way of example only cladding elements of the disclosure.

DETAILED DESCRIPTION

Figure 1B:
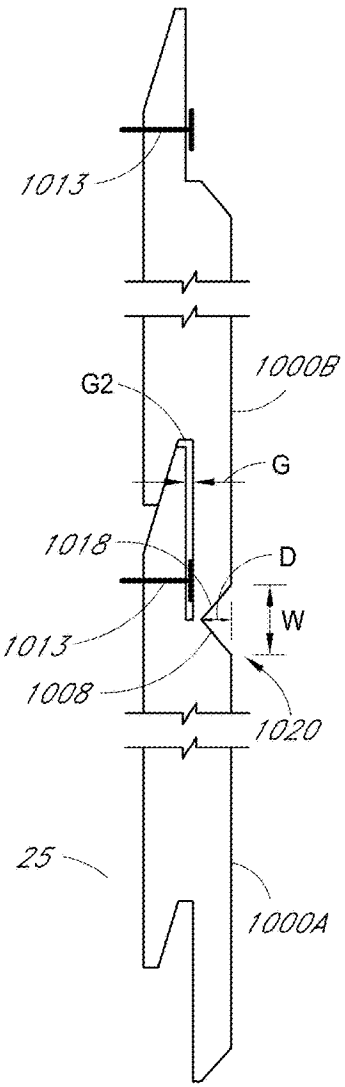
FIG. 1B is a cross-sectional view of a cladding system having two mated cladding elements of FIG. 1A.

Although making and using various embodiments are discussed in detail below, it should be appreciated that the embodiments described provide inventive concepts that may be embodied in a variety of contexts. The embodiments discussed herein are merely illustrative of ways to make and use the disclosed devices, systems and methods and do not limit the scope of the disclosure.

In the description which follows like parts may be marked throughout the specification and drawing with the same reference numerals, respectively. The drawing figures are not necessarily to scale and certain features may be shown exaggerated in scale or in somewhat generalized or schematic form in the interest of clarity and conciseness.

Unless the context clearly requires otherwise, throughout the description and the claims, the words "inclined surface", "angle of inclination", and the like are to be construed as referring to inclination with respect to the plane that extends perpendicularly from the first face. In the instance where the cladding element is installed in a vertical arrangement, the horizontal plane is the plane that extends perpendicularly from the first face. Accordingly in the following description the terms horizontal plane and the plane that extends perpendicularly from the first face are sometimes used interchangeably.

Cladding elements can be assembled to produce cladding systems (e.g., wall portions). These cladding systems can be installed on an exterior or interior surface of a wall to provide aesthetic improvement, improved weather resistance, improved thermal efficiency, improved structural stability, and/or many other improvements to an existing wall. For example, the cladding systems disclosed herein can be installed on a wooden frame or other internal wall structure.

Figure 1A:
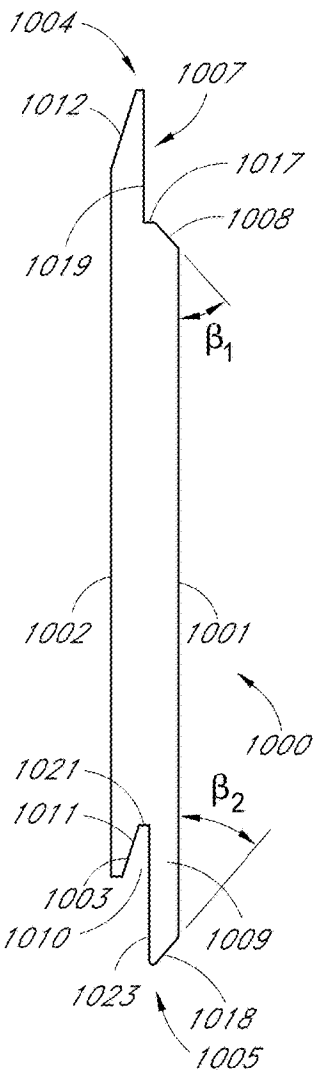
FIG. 1A is a cross-sectional view of an embodiment of a cladding element.

FIGS. 1A and 1B illustrate an embodiment of a cladding element 1000 and of a cladding system, respectively. The cladding element 1000 includes a front face 1001 (e.g., a face extending outward from a wall when the cladding system is assembled). As illustrated, the cladding element 1000 includes a rear face 1002 opposite the front face 1001.

The cladding element 1000 includes a first profiled edge 1004 extending between the front and rear faces 1001, 1002. The cladding element 1000 can include a second profiled edge 1005 extending between the front and rear faces 1001, 1002 on a side of the element 1000 opposite the first profiled edge 1004. The first profiled edge 1004 of a first element 1000A (FIG. 1B) can be configured to mate with the second profiled edge 1005 of a second cladding element 1000B.

The first profiled edge (e.g., mating edge) 1004 of the cladding element 1000 can include a recessed portion 1007. The recessed portion 1007 can include a front face 1019 substantially parallel to and positioned rearward of the front face 1001 of the cladding element 1000. The first profiled edge 1004 can include a first angled portion 1008 extending from the front face 1001 of the cladding element 1000 toward the rear face 1002 of the element 1000 away from the second profiled edge 1005 of the element 1000. The first profiled edge 1004 can include a second angled portion 1012 extending from the rear face 1002 of the element 1000 toward the front face 1001 of the element 1000 and away from the second profiled edge 1005 of the element 1000.

The second profiled edge 1005 of the cladding element 1000 can include a first angled portion 1018 extending away from the front face 1001 of the element 1000 toward the rear face 1002 and away from the first profiled edge 1004 of the cladding element 1000. The second profiled edge 1005 of the cladding element 1000 can include a recessed portion 1010. The recessed portion 1010 can include a rear face 1023 substantially parallel to and positioned forward of the rear face 1002 of the cladding element 1000. The portion of the second profiled edge 1005 between the recess 1010 and the front surface 1001 of the cladding element 1000 can include an overlap portion 1009. The second profiled edge 1005 can include second angled portion 1003 having a sloped surface 1011 extending in a direction from the rear surface 1002 toward the front face 1001 and toward the first profiled edge 1004 of the cladding element 1000.

In some embodiments, the recessed portion 1007 of the includes an offset portion 1017 between the angled portion 1008 and the front face 1019 of the recessed portion 1007, as measured substantially perpendicular to the first face 1001 of the cladding element 1000. The overlap portion 1009 can include an abutment face 1021 between the angled portion 1018 and a rear face 1023 of the overlap portion 1009 as measured substantially perpendicular to the second face 1002 (e.g., the rear face) of the cladding element 1000.

As illustrated in the cladding system of FIG. 1B, the angled portion 1018 of a first cladding element 1000*a* can form a "V" groove 1020 with the angled portion 1008 of the recessed portion 1007 of a second cladding element 1000*b* when the first and second cladding elements 1000*a*, 1000*b* are mated with each other. The V-groove 1020 configuration can simulate V-groove configurations sometimes used with wood cladding elements. Use of the V-groove shape can provide a shadowed, seamed look between the adjacent cladding elements in the system while reducing the likelihood that dirt, water, or other environmental hazards collect in the groove. For example, as compared to a system wherein the cladding elements include surface 1018 perpendicular to the front face 1001 of the element, the V-groove shape can permit more rain access to the groove to wash out debris, while the sloped shape of the V-groove leads the rainwater along the sloped surface 1008 and out of the groove 1020.

The overall shape of the groove 1020 can be altered through adjustment of certain parameters. For example, the angles β1, β2 of the angled portions 1008, 1018 as measured from the first surface 1001 (e.g. the front face) can be varied. In some instances, the angle β1 of angled portion 1008 is the same as the angle β2 of angled portion 1018. In some cases, the angle β1 of angled portion 1008 is greater than or less than the angle β2 of angled portion 1018. Increasing the value of one or more of the angles β1, β2 while maintaining the depth D of the groove 1020 can decrease the width W of the groove 1020. Many variations are possible.

As illustrated in FIG. 1B, the depth D of the groove 1020 in a cladding system can be adjusted by adjusting the depth (e.g., as measured from the first surface 1001) to which the angled surfaces 1008, 1018 extend. Variance of the depth D of the groove 1020 can vary the visual and/or environmental characteristics of the assembled cladding elements 1000A, 1000B. For example, increasing the depth D of the groove 1020 can increase the light contrast between the front faces 1001 of the elements 1000A, 1000B and the groove 1020 by creating a darker shadow within the groove 1020. In some embodiments, reducing the depth D of the groove 1020 and/or reducing the angle β1 of the angled portion 1008 can decrease accumulation of particulates (e.g., sand, dust, etc.). For example, reducing the angle β1 provides a steeper slope off of which particulates will fall under the influence of gravity prior to accumulating on the angled portion 1008. In some cases, reducing the depth D increases the access of rain and/or other liquid to the full surface of the groove 1020 to wash away particulates.

In some cases, a gap G can remain between the rear face 1023 of the overlap portion 1009 of a first cladding element 1000*a* and the front face 1019 of the recessed portion 1007 of a second cladding element 1000*b* when the first and second cladding elements 1000*a*, 1000*b* are connected to each other. The gap G can be between 0.01 inches and 0.1 inches when measured perpendicular to the first face 1001 of first cladding element 1000*a*. In some embodiments, the gap G is approximately 0.06 inches measured substantially perpendicular to the first face 1001 of the first cladding element 1000*a*. Many variations are possible. A second gap G2 in the cladding system can be formed between the abutment face 1021 of the second cladding element 1000*b* and the tip of the first profiled edge 1004 of the first cladding element 1000*a*. The second gap G2 can be connected to and/or continuous with the gap G.

The gaps G and/or G2 can be sized and/or shaped to accommodate adhesives, sealants, insulators, and/or other materials. For example, an adhesive material can be applied to the front face 1019 of the recessed portion of the first cladding element 1000B and/or to the rear face 1023 of the overlap portion 1009 of the second cladding element 1000A before the first and second cladding elements 1000A, 1000B are mated together. Positioning materials in the gap G between the front face 1019 of the recessed portion of the first cladding element 1000B and the rear face 1023 of the overlap portion 1009 of the second cladding element 1000A can increase the weather resistance of the assembled cladding elements 1000A, 1000B by reducing the likelihood that moisture (e.g., rain, condensation, etc.) will pass between the groove 1020 and the second surfaces 1002 of the cladding elements 1000A, 1000B. In some cases, sealant or other materials can be inserted into the second gap G2 without insertion of sealant into the other gap G.

In some embodiments, the interface between the first profiled side edge 1004 of the first cladding element 1000A and the second profiled side edge 1005 of the second cladding element 1000B can provide a tortuous (e.g., tedious, serpentine, labyrinthine) path through which moisture would be required to travel to reach the second surface 1002 of the cladding elements 1000A, 1000B from the groove 1020. For example, the interface can include a plurality of turns (e.g., 3 turns, 4 turns, 5 turns, etc.) through which the moisture would be required to pass. In some cases, the tortuous interface between the two cladding elements 1000A, 1000B would force the moisture to switch direction one or more time (e.g., vertically and/or laterally) when traveling from the groove 1020 to the second surfaces 1002.

Figure 1C:
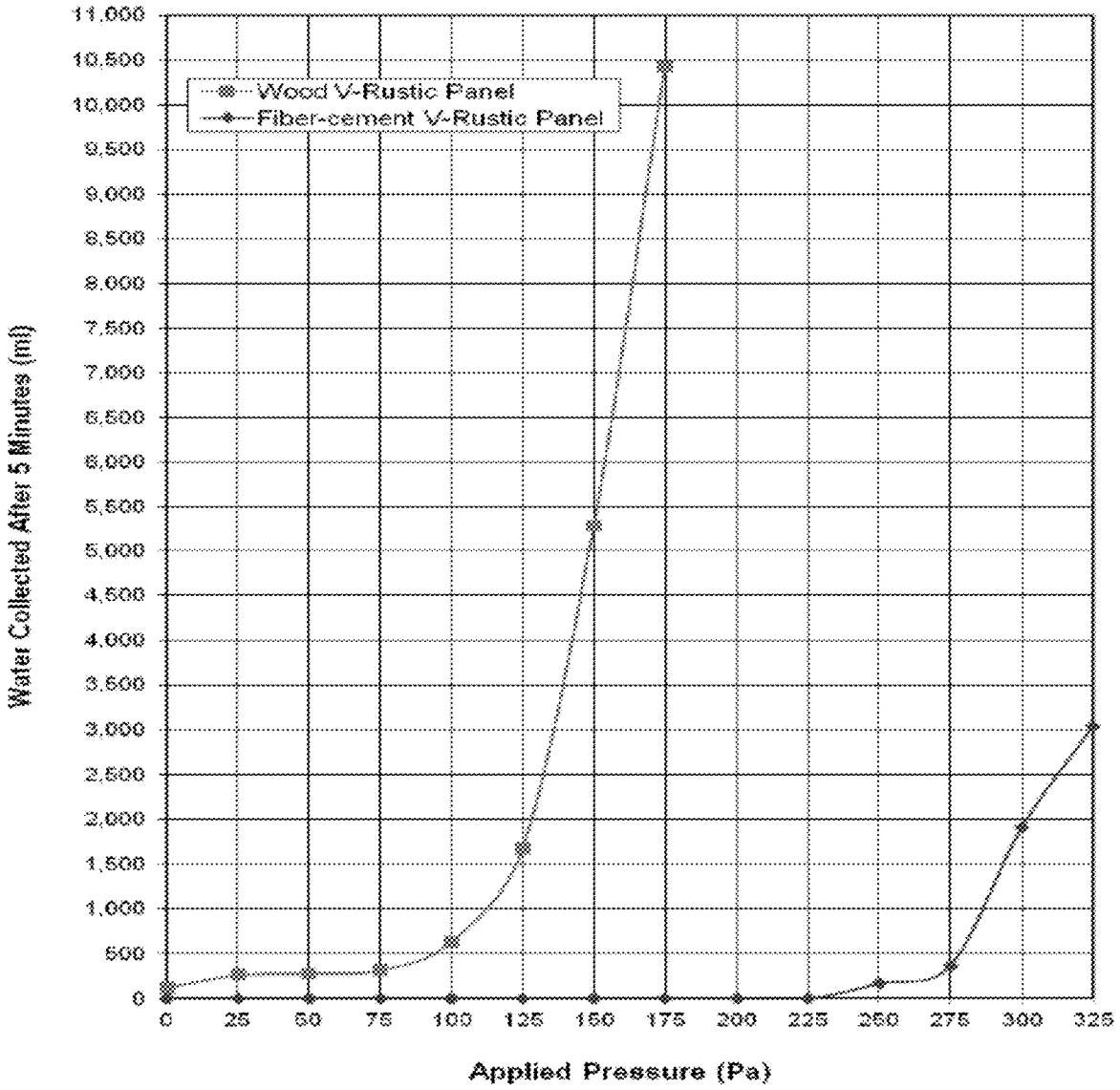
FIG. 1C is a graph illustrating the results of an ASTM E 331 test performed on the cladding system of FIG. 1B.

In some embodiments, the interface between the first profiled side edge 1004 of the first cladding element 1000*a* constructed from fibre cement and the second profiled side edge 1005 of the second cladding element 1000*b* constructed from fibre cement can have significantly reduced water leakage (e.g., water through a thickness of the assembled elements 1000*a*, 1000*b*) as compared to two cladding elements constructed from wood. Such water-resisting characteristics are immediately apparent when conducting an ASTM E 331 test. The ASTM E 331 test comprises constructing a cladding element system (e.g., a cladding element wall) comprised of multiple mated cladding elements. In the present case, a 4' by 8' cladding system control specimen consisting of V-Groove wood elements was constructed, as was a 4' by 8' cladding system test specimen consisting of V-Groove fibre cement elements (e.g., elements 1000, described above). The respective walls were subject to incrementally-increased water pressure until leakage was detected on a back side of the wall. Water was applied for 5 minutes at each pressure increment. When water was detected on the back side of the wall, the pressure was maintained for 5 minutes and the leaked water was collected for measurement. When subject to the ASTM E 331 test, the fibre cement elements resisted water penetration for water pressures up to at least 225 psi, whereas wood elements having substantially the same geometric shapes as the elements 1000*a*, 1000*b*, permitted water penetration at 0 psi. In some cases, the water penetration through the fibre cement elements was less at 325 psi than the water penetration through the wood elements at 150 psi. Results of the test are reflected in FIG. 1C.

As illustrated in FIG. 1B, the cladding element 1000 may be installed on a wall 25 (e.g., an exterior wall) of a building by inserting one or more fasteners 1013 through the front face 1019 of the recessed portion 1007. The fasteners 1013 can be positioned such that the overlap portion 1009 of a second cladding element 1000 covers or hides the fasteners 1013 from view when the second cladding element 1000 is mated with the first cladding element. Utilizing such a fastening process (e.g., "blind" nailing) can improve the aesthetics of the assembled cladding elements 1000. In some cases, blind nailing can increase the durability of the assembled cladding elements 1000 by, for example, reducing exposure of the fasteners and their respective holes to moisture and other outside elements. In some applications, blind nailing can reduce the costs of installing the cladding elements 1000 on a wall by reducing the number of fasteners required to install the cladding elements 1000 and thereby reducing the amount of time required to install the cladding elements 1000. For example, traditional wood cladding elements often require the use of fasteners on both the top and bottom sides of the cladding elements. The cladding elements 1000 of the present disclosure, however, can be installed without the use of fasteners on the bottom side (e.g., the second profiled edge 1005).

In some embodiments, the use of cladding elements 1000 to cover a wall (e.g., to assembly a cladding system) can reduce the overall installation time of the cladding elements 1000 (e.g., as compared to the time required to install traditional wood cladding elements). For example, an installer may use a level or other tool to confirm the alignment of the first-installed cladding element 1000 (e.g., the bottom cladding element) when installing the cladding elements 1000. Subsequent cladding elements 1000 can be installed without the use of an alignment tool, as the mating of profiled edges 1004, 1005 of adjacent cladding elements align the subsequent cladding elements 1000 with the first-installed cladding element 1000. The self-alignment of the subsequent cladding elements 1000 can reduce the overall installation time of the cladding elements 1000 by 10-20%. In some cases, the self-alignment of the cladding elements 1000 can increase installation efficiency by over 25%. For example, on average, the self-alignment of the cladding elements 1000 can reduce the installation time to under two minutes. In some cases, the average installation time per cladding element can be approximately 100 seconds.

The shiplap-type labyrinthine connection between the first and second profiled edges 1004, 1005 of the cladding elements 1000 can facilitate either vertical installation (e.g., the length of each cladding element 1000 extends vertically) or horizontal installation (e.g., the length of each cladding element 1000 extends horizontally) of the cladding elements 1000 onto the wall of a structure. For example, as explained above, the labyrinthine connection between the first and second profiled edges 1004, 1005 can reduce the likelihood that moisture would pass from the grooves 1020 to the rear faces 1002 of the cladding elements 1000.

In some embodiments, the shiplap-type labyrinthine connection between the first and second profiled edges 1004, 1005 of the cladding elements 1000 in a cladding system can increase the overall wind resistance of the installed cladding elements. For example, the labyrinthine engagement between the cladding elements 1000 can reduce the amount of wind access between the cladding elements 1000 and the wall or other structure onto which the cladding elements 1000 are installed. In some cases, the labyrinthine engagement between the cladding elements 1000 can increase the wind resistance of the installed cladding elements by over 100% as compared to the wind resistance of plank cladding elements. In some cases, the cladding elements 1000 can withstand wind-induced loads of over 85 pounds per square foot. Reduction of wind access to a rear side of the cladding elements 1000 can reduce pressure build up between the cladding elements 1000 in a cladding system and the wall onto which they are installed.

Figure 1D:
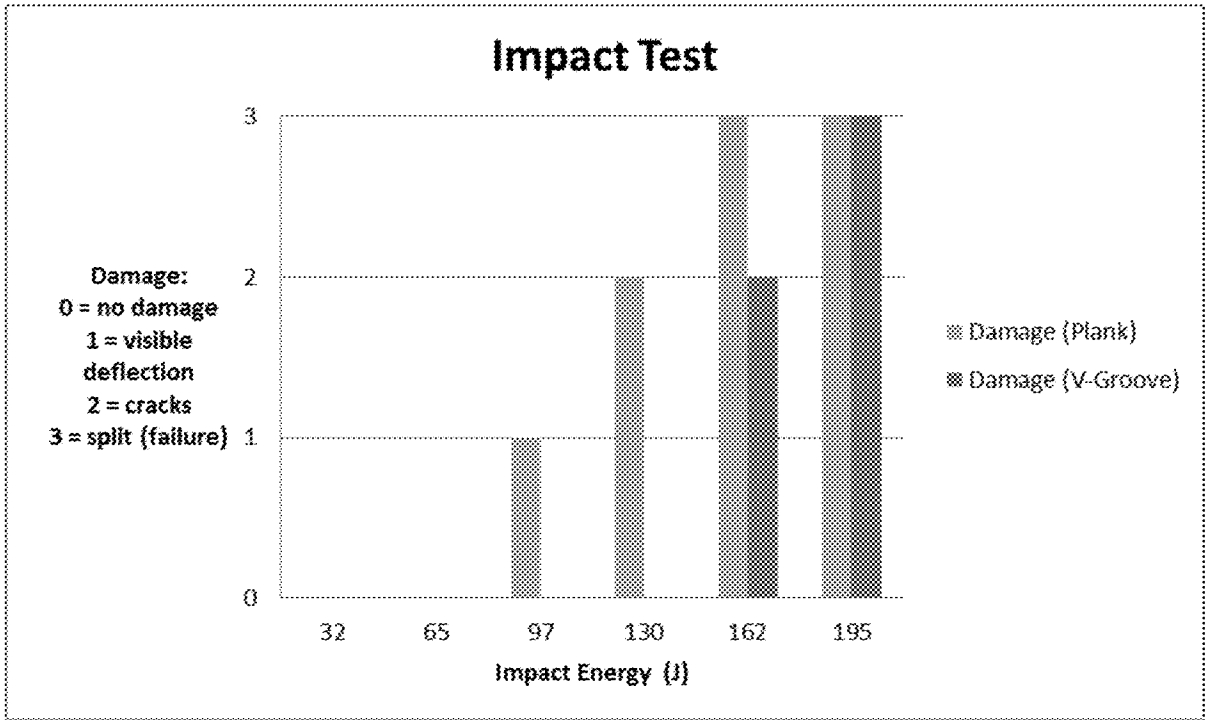
FIG. 1D is a graph illustrating the results of an impact test performed on the cladding system of FIG. 1B.

Use of cladding elements 1000 can have a significant impact on the durability of a wall (e.g., cladding system). Such impact has been proven via testing of impact resistance on a test cladding system specimen 6' by 8' wall comprising fibre cement cladding elements 1000. The control cladding system specimen for the test was a 6' by 8' wall of fibre cement planks. Both the test specimen and the control specimen were subject to impacts of incrementally-increasing energy. The test results indicate that walls (e.g., cladding systems) constructed from cladding elements 1000 having the shiplap-type labyrinthine connections can realize an increased impact resistance of over 20% as compared to plank walls. In some cases, the cladding elements 1000 are capable of withstanding over 130 Joules of energy before cracking, as compared to 97 Joules for a plank wall. In some embodiments, the cladding elements 1000 are capable of withstanding over 160 Joules of energy before splitting, as compared to 130 Joules for a plank wall. In some cases, the shiplap-type labyrinthine connection of the cladding elements 1000 (e.g., the overlap realized in the labyrinthine connections) can facilitate energy distribution among adjacent cladding elements in a more efficient manner than is the case with plank walls. The use of joints to connect adjacent cladding elements, as described below, can further increase energy distribution and/or impact resistance of the cladding elements. Results of the testing are shown in FIG. 1D.

Figure 2:
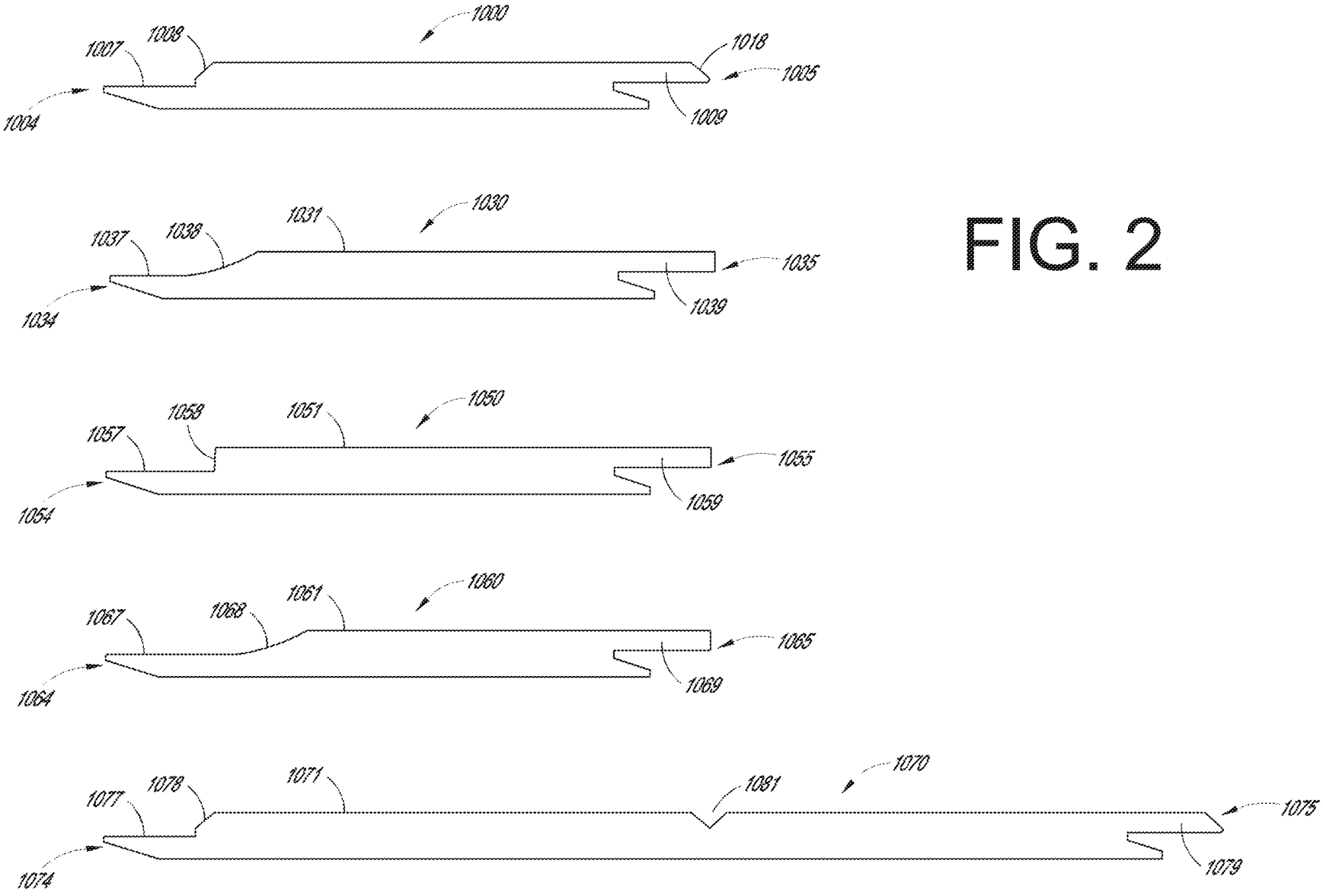
FIG. 2 is a cross-sectional view of a plurality of embodiments of cladding elements.

FIG. 2 illustrates additional embodiments of cladding elements 1030, 1040, 1050, 1060, and 1070. For example, in some embodiments, a cladding element 1030 can have a transition portion 1038 between the first surface 1031 and the front recessed surface 1037. The transition portion 1038 can have a concave shape. Such a configuration is sometimes referred to as cove shiplap. Additionally, a square channel configuration can be utilized, wherein a transition portion 1058 of the cladding element 1050 is substantially planar and substantially perpendicular (e.g., within 5 degrees of perpendicular) to one or both of the front recessed surface 1057 and the first surface 1051. In some cases, the transition portion 1058 of a first cladding element 1050 is spaced from second profiled side edge 1055 of a second cladding element 1050 when the second profiled side edge 1055 of the second cladding element 1050 is mated with the first profiled side edge 1054 of the first cladding element 1050. In some cases, a cladding element 1060 can have a wide cove configuration wherein the concave transition portion 1068 of a first cladding element 1060 is spaced from second profiled side edge 1065 of a second cladding element 1060 when the second profiled side edge 1065 of the second cladding element 1060 is mated with the first profiled side edge 1064 of the first cladding element 1060.

In some embodiments, a cladding element 1070 can include one or more channel features 1081 in the first surface 1071 of the cladding element 1070. The channel features 1081 can have the same shape (e.g., V groove, cove, wide cove, square channel, etc.) as the shapes of the grooves formed between mated cladding elements.

Cladding elements may be installed in cladding systems in conjunction with flashing strips, caulk, and/or other weatherproofing materials to reduce moisture transfer to the structure on which the cladding elements are installed. In some cases, it may be advantageous to provide weatherproofing structure on the cladding elements themselves to reduce or eliminate the need for additional weatherproofing materials and/or waterproofing installation steps. For example, the cladding elements may include one or more joint features configured to facilitate drainage of moisture from the assembled/installed cladding elements away from the structure on which the cladding elements are installed. The joint features can be configured to facilitate moisture drainage from the cladding elements as the cladding elements shrink and/or expand after installation (e.g., due to temperature change, evaporation, chemical processes, etc.). In some embodiments, the joint features create a tortuous and/or labyrinthine passage between a front side of the cladding elements and a back side of the elements, thereby reducing the amount of moisture passage between the front side of the cladding elements and the back side of the cladding elements when the cladding elements are installed on a wall or other structure. In some cases, cladding elements which include joint features are capable of being installed both vertically (e.g., having joint features on top and bottom sides of the cladding elements) and horizontally (e.g., having joint features on lateral sides of the cladding elements), depending on the application. Examples of such joint features are described below.

FIGS. 3A-3D illustrate an embodiment of a cladding element 2000 which can include any of the profiled edge mating features described above with respect to FIGS. 1A-2. For example, the first mating edge 2006 of the cladding element 2000 can have a similar or identical profile to any of the first profiled edges of the cladding elements described above (see, e.g., FIG. 3B). Additionally, the second mating edge 2008 of the cladding element 2000 can be configured to mate with the first mating edge 2006 of another cladding element 2000 in any manner described above.

Figure 3A:
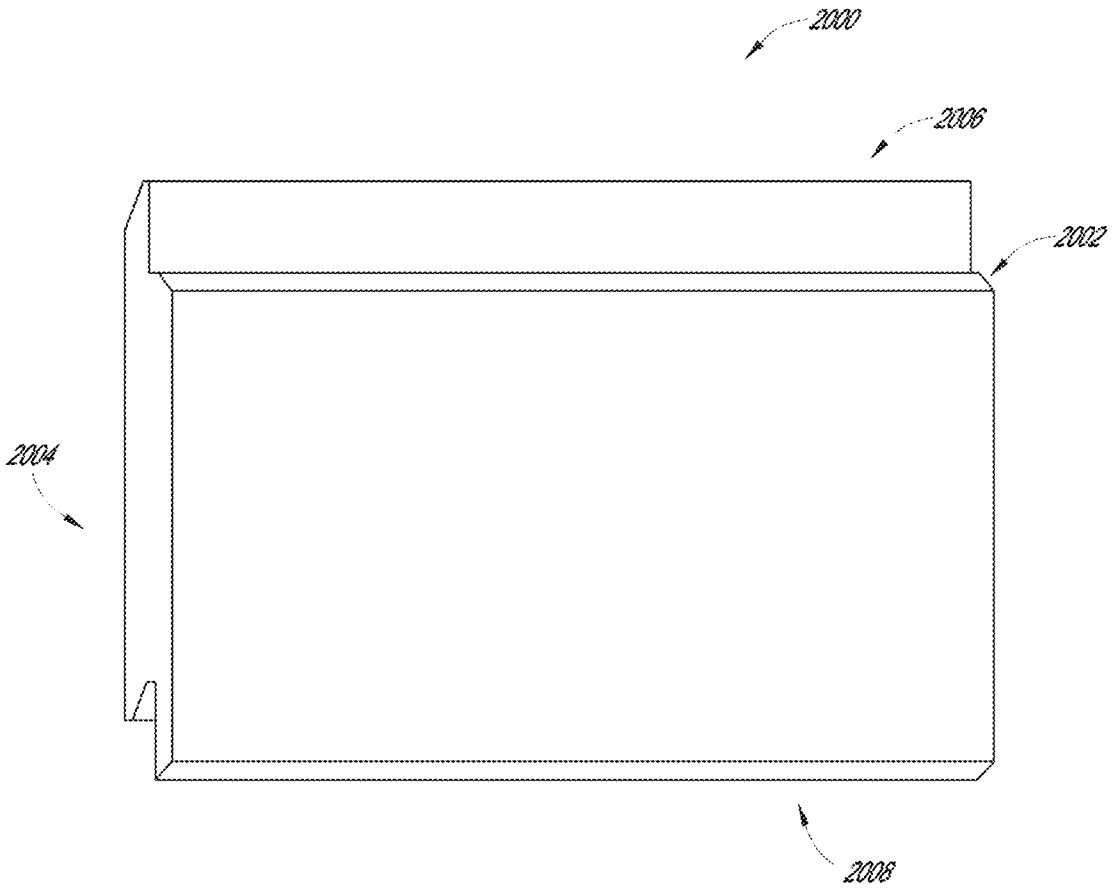
FIG. 3A is a top view of another embodiment of a cladding element.
Figure 3B:
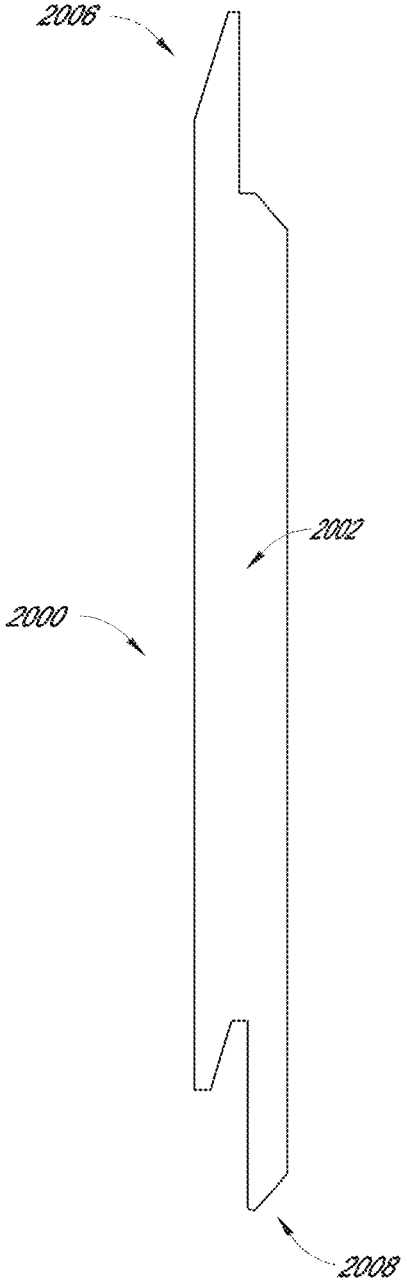
FIG. 3B is a left side view of the cladding element of FIG. 3A.

As illustrated in FIG. 3A, the cladding element 2000 is bound on one end by a first joint edge 2002. The cladding element 2000 includes a second joint edge 2004. In some embodiments, the second joint edge 2004 is distanced from and/or positioned opposite the first joint edge 2002. The first and second joint edges 2002, 2004 can be sized and/or shaped to couple with the first or second joint edges 2002, 2004 of an adjacent cladding element.

Figure 3C:
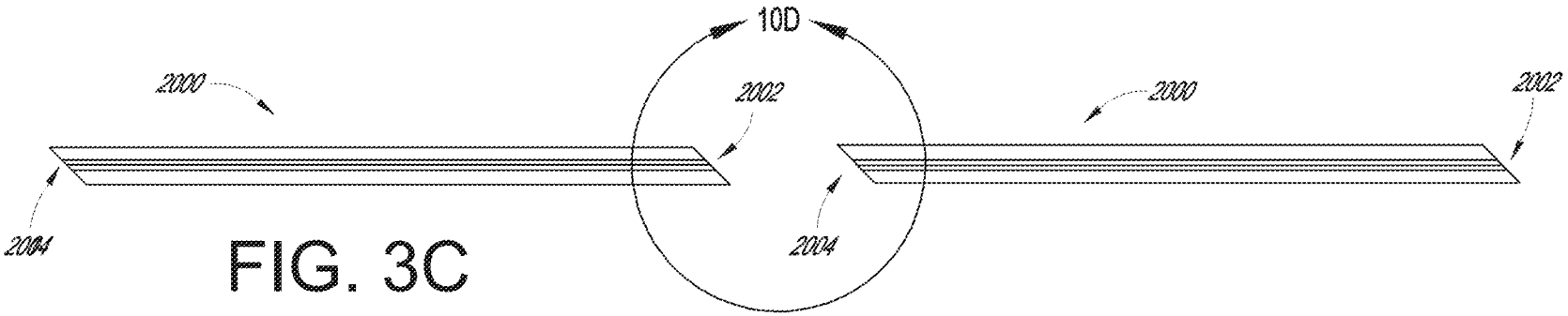
FIG. 3C is a bottom view of two cladding elements of FIG. 3A.
Figure 3D:
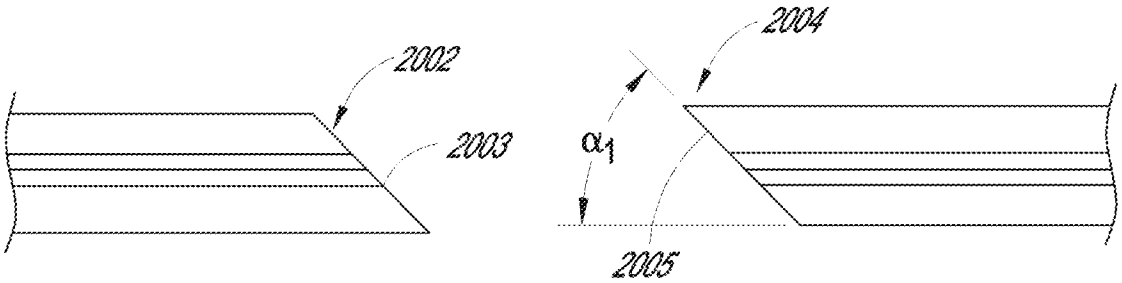
FIG. 3D is a close up bottom view of the joint edges of two cladding elements of FIG. 3A.
Figure 4A:
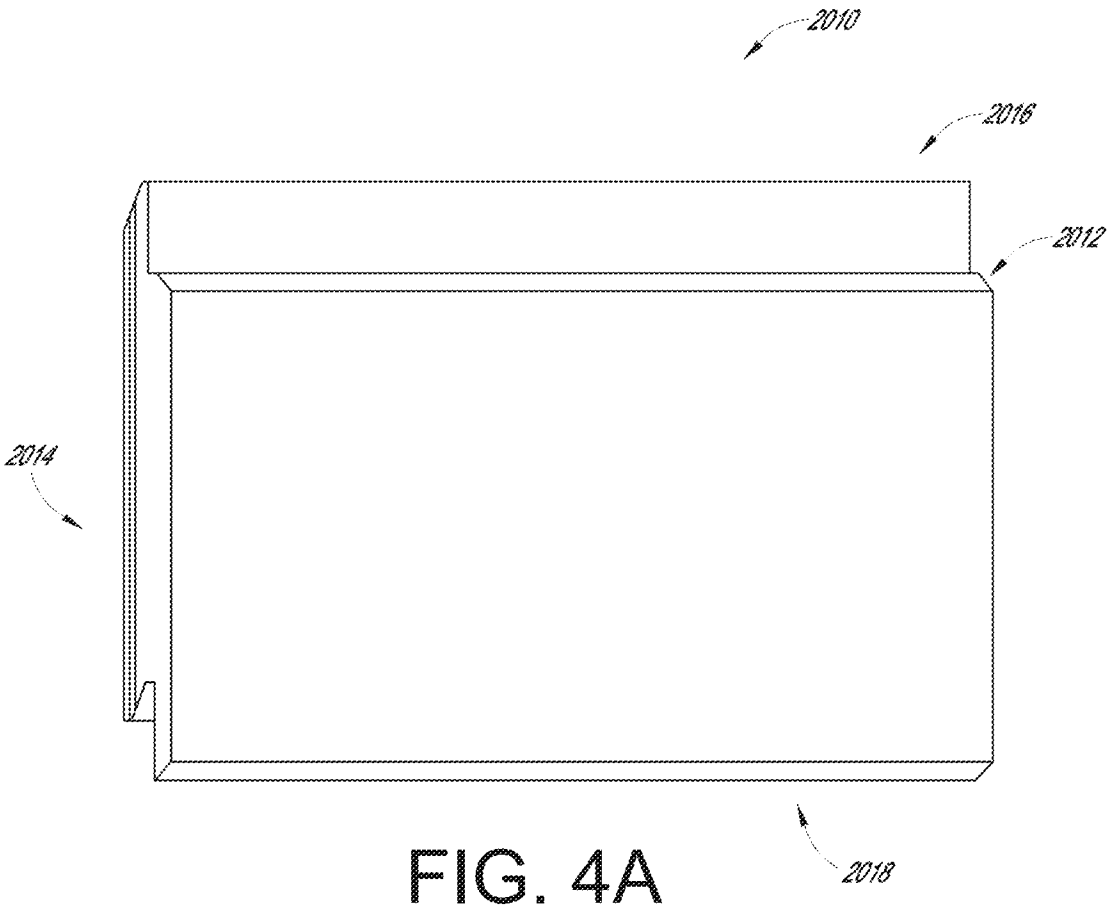
FIG. 4A is a top view of another embodiment of a cladding element.
Figure 4B:
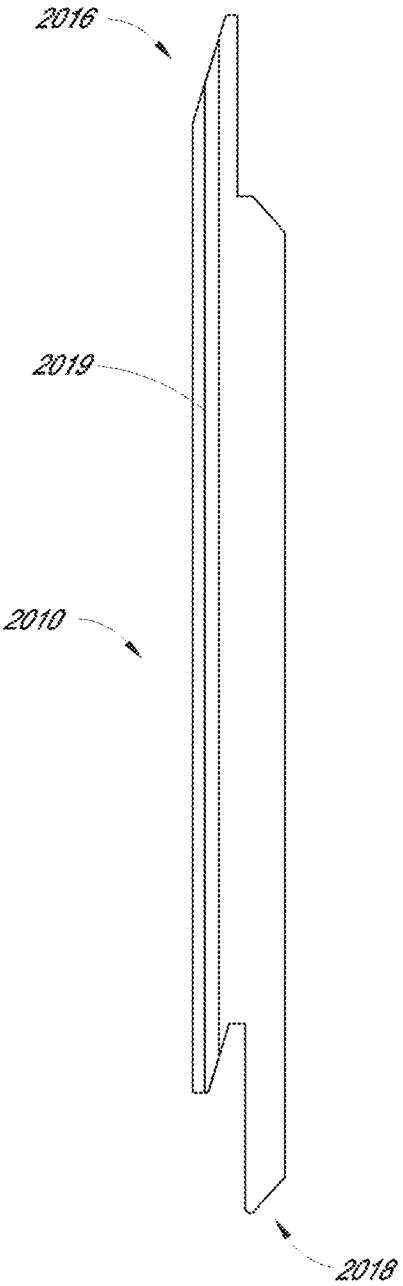
FIG. 4B is a left side view of the cladding element of FIG. 4A.
Figure 4C:
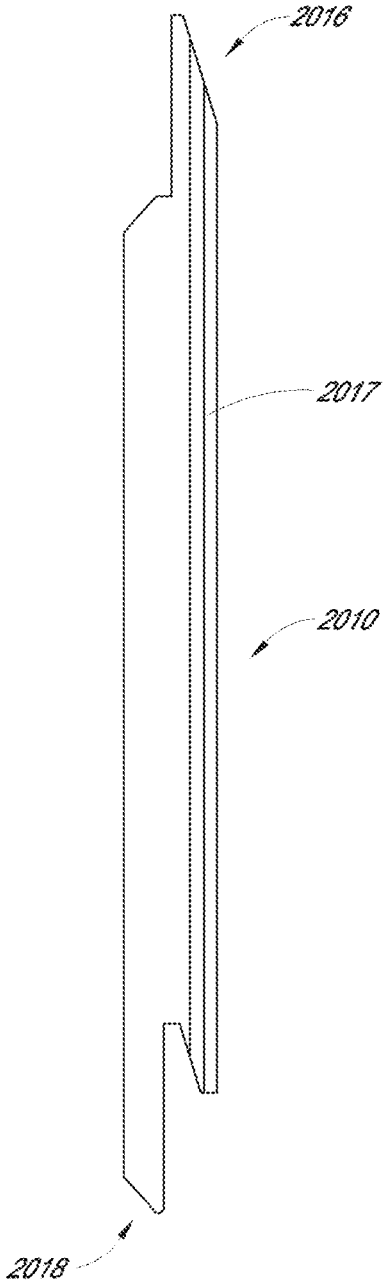
FIG. 4C is a right side view of the cladding element of FIG. 4A.
Figure 4D:
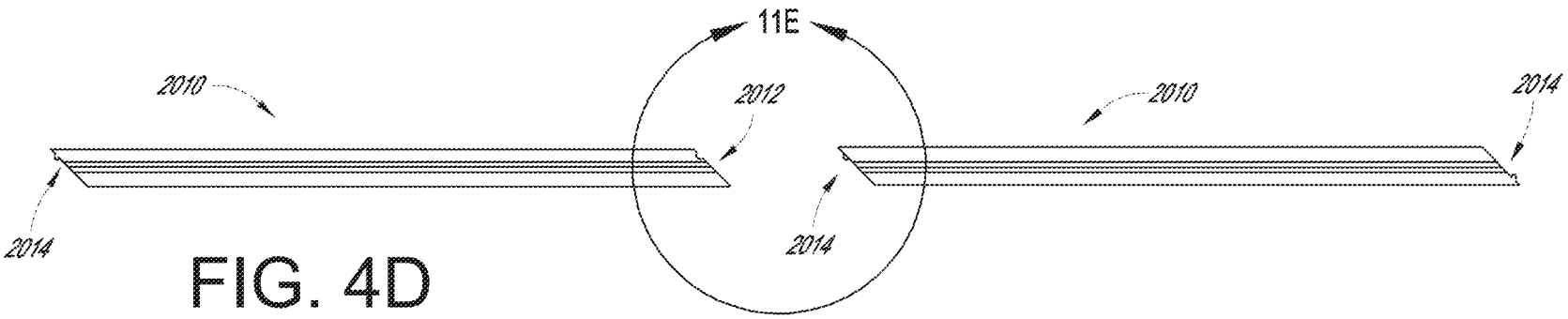
FIG. 4D is a bottom view of two cladding elements of FIG. 4A.
Figure 4E:
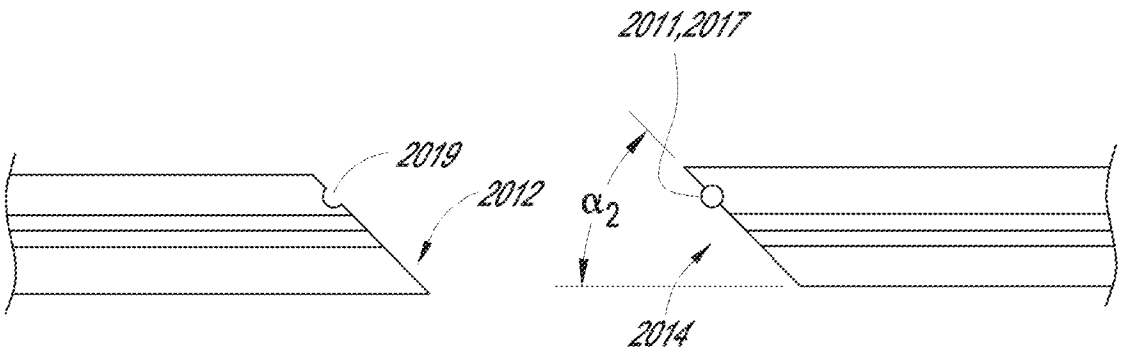
FIG. 4E is a close up bottom view of the joint edges of two cladding elements of FIG. 4A.

The cladding element 2000 can include a first mating edge 2006. As illustrated, the cladding element 2000 can include a second mating edge 2008 distanced from and/or positioned opposite the first mating edge 2006. The first and second mating edges 2006, 2008 can be sized and/or shaped to couple with the first or second mating edges of an adjacent cladding element. In some embodiments, the cladding element 2000 is generally planar and has a generally rectangular shape bound on two opposite sides by the first and second joint edges 2002, 2004 and on the other opposite sides by the first and second mating edges 2006, 2008. As illustrated in FIGS. 3C-3D, the cladding element 2000 can include a first joint feature on the first joint end 2002. For example, the cladding element 2000 can include a sloped joint surface 2003 on the first joint end 2002. The second joint end 2004 can include a second joint surface 2005 sized and/or shaped to matingly correspond to the first joint surface 2003. A slope angle $\alpha$1 of the joint surfaces 2003, 2005, as measured from a rear surface of the cladding element 2000, can be between 35 and 55 degrees. In some embodiments, the slope angle $\alpha$1 is between 10 and 40 degrees, between 15 and 55 degrees, and/or between 30 and 85 degrees. Many variations are possible.

FIGS. 4A-4E illustrate an embodiment of a cladding element 2010 wherein some numerical references are the same as or similar to those described previously for cladding element 2000. For example, mating edges 2016, 2018 can the same as or similar to the mating edges 2006, 2008 of the cladding element 2000. The angle $\alpha$2 of the joint surfaces 2013, 2015 as measured from a rear surface of the cladding element 2010 can be the same as or similar to the angle $\alpha$1 of the joint surfaces 2003, 2005 of the cladding element 2000. As illustrated in FIGS. 4B-4E, the first and second joint ends 2012, 2014 can include sloped surfaces having sealing channels 2017, 2019 extending along at least a portion of the length of the first and second joint ends 2012, 2014. The sealing channels 2017, 2019 can be sized and/or shaped to accommodate a sealing element, such as an elastomeric rod, caulk, and/or flashing material. For example, the sealing channels 2017, 2019 can be configured to receive a rod 2011 constructed from silicone, rubber, or some other compressible and/or polymeric material. The rod 2011 can reduce moisture transfer from a front side of the cladding elements 2010 to the structure on which the cladding elements 2010 are installed. In some embodiments, the rod 2011 can increase the frictional engagement between adjacent cladding elements 2010 and reduce relative motion between adjacent cladding elements 2010.

FIGS. 5A-5F illustrate an embodiment of a cladding element 2020 wherein some numerical references are the same as or similar to those described previously for cladding element 2000. For example, mating edges 2026, 2028 of the cladding element 2020 can the same as or similar to the mating edges 2006, 2008 of the cladding element 2000.

Figure 5A:
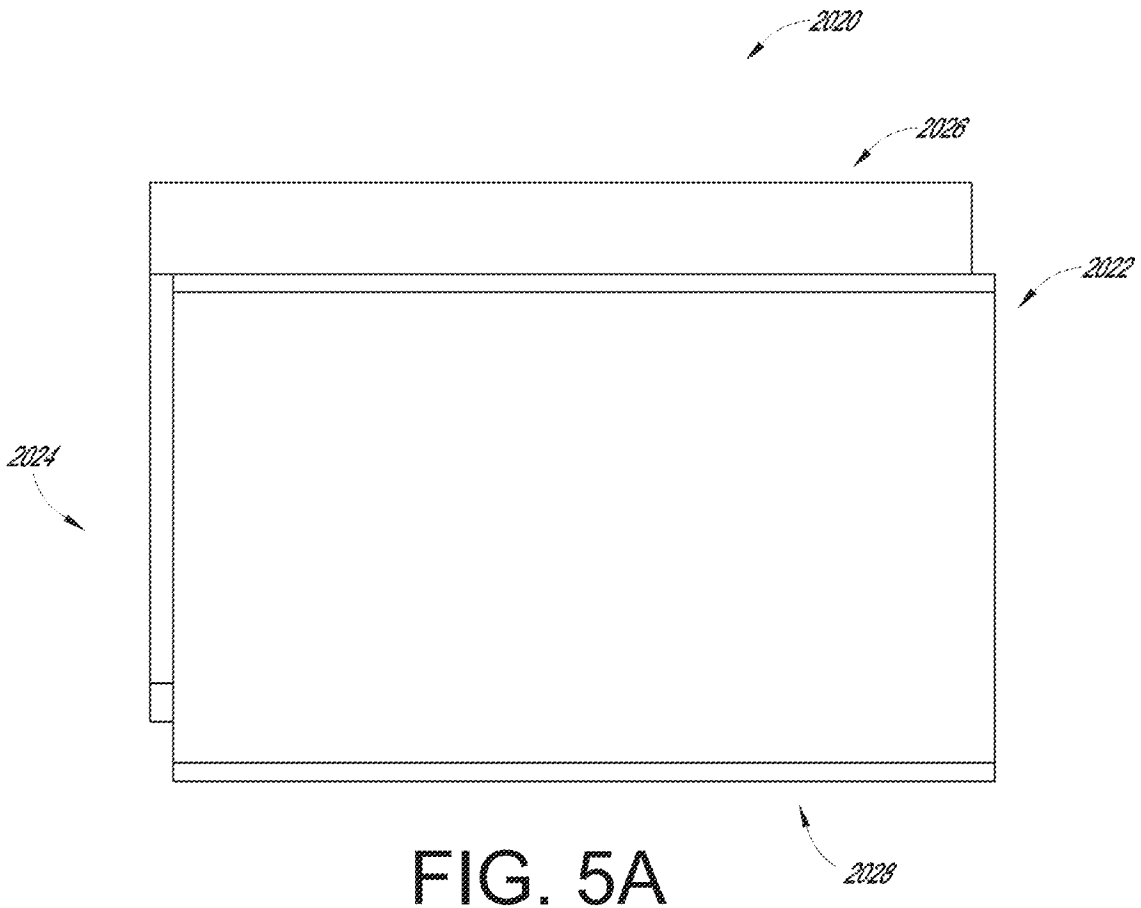
FIG. 5A is a top view of another embodiment of a cladding element.
Figure 5B:
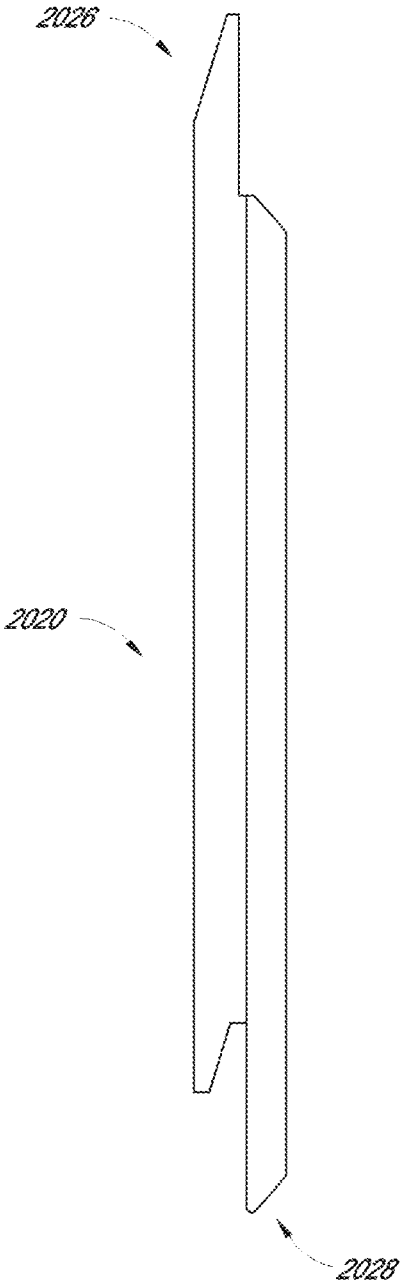
FIG. 5B is a left side view of the cladding element of FIG. 5A.
Figure 5C:
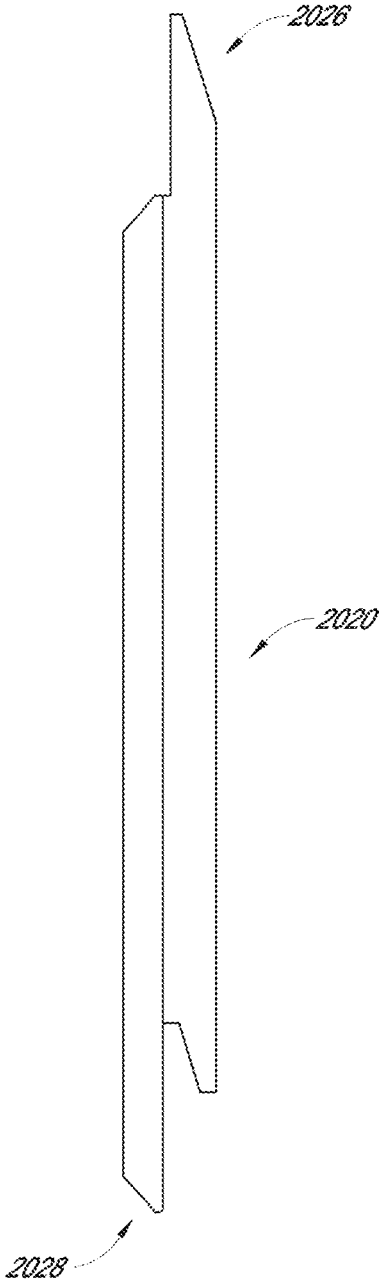
FIG. 5C is a right side view of the cladding element of FIG. 5A.
Figure 5D:
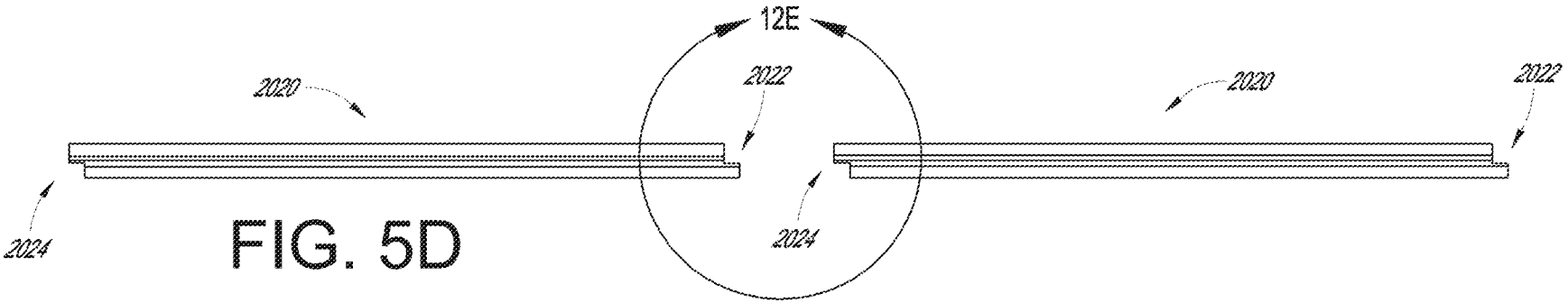
FIG. 5D is a bottom view of two cladding elements of FIG. 5A.
Figure 5E:
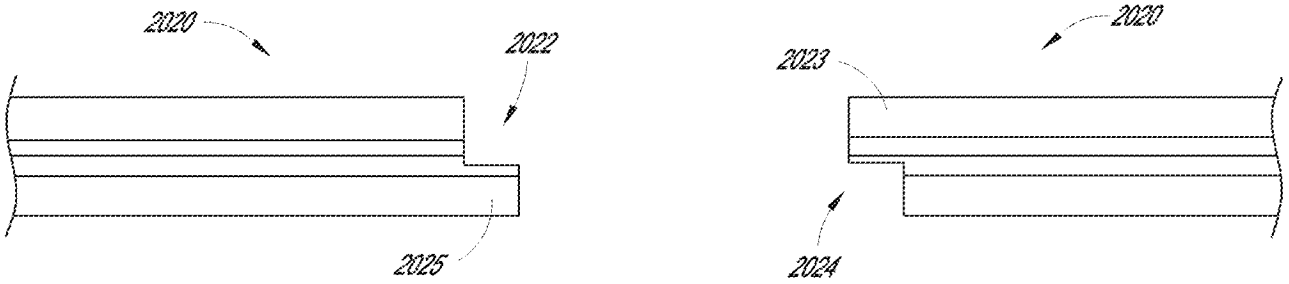
FIG. 5E is a close up bottom view of the joint edges of two cladding elements of FIG. 5A.

As illustrated in FIGS. 5D-5E, the cladding element 2020 can include a first overlap portion 2025 on the first joint end 2024. In some cases, the cladding element 2020 includes a second overlap portion 2023 on the second joint end 2024. The first overlap portion 2025 can be configured to overlap (e.g., in a direction substantially parallel to the mating edges 2026, 2028 of the cladding elements 2020) a second overlap portion 2023 of a second cladding element 2020 when the cladding elements 2020 are installed on a wall. The overlap of the first and second overlap portions 2025, 2023 can create a labyrinthine seal between the adjacent cladding elements 2020 to reduce moisture passage through the assembled cladding elements 2020. In some cases, the overlap portions 2023, 2025 remain overlapped as the cladding elements 2020 shrink or expand (e.g., in response to chemical changes, evaporation, temperature changes, etc.).

Figure 5F:
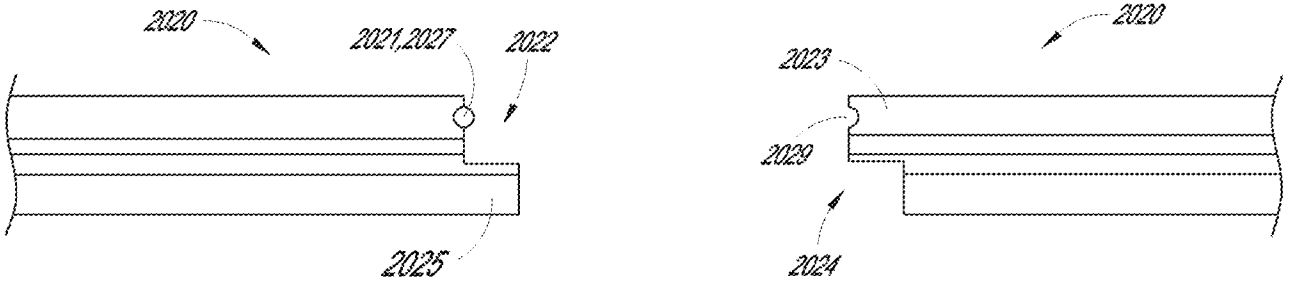
FIG. 5F is a close up bottom view of the joint edges of an embodiment of a cladding element having a sealing member.

In some embodiments, as illustrated in FIG. 5F, one or more of the overlap portions 2023, 2025 includes a sealing channel 2029. The channel 2029 can be configured to receive a sealing element. For example, the channel 2029 can be configured to receive a sealing rod 2021. The sealing rod 2021 can be the same as or similar to the sealing rod 2011 described above. As illustrated in FIG. 5F, the cladding element 2020 can include a second channel 2027 positioned on a surface corresponding to the overlap portion 2023, 2025 in which the sealing channel 2029 is positioned. In some cases, the second channel 2027 can be sized and/or shaped to accommodate at least a portion of the sealing rod 2021.

Figure 6A:
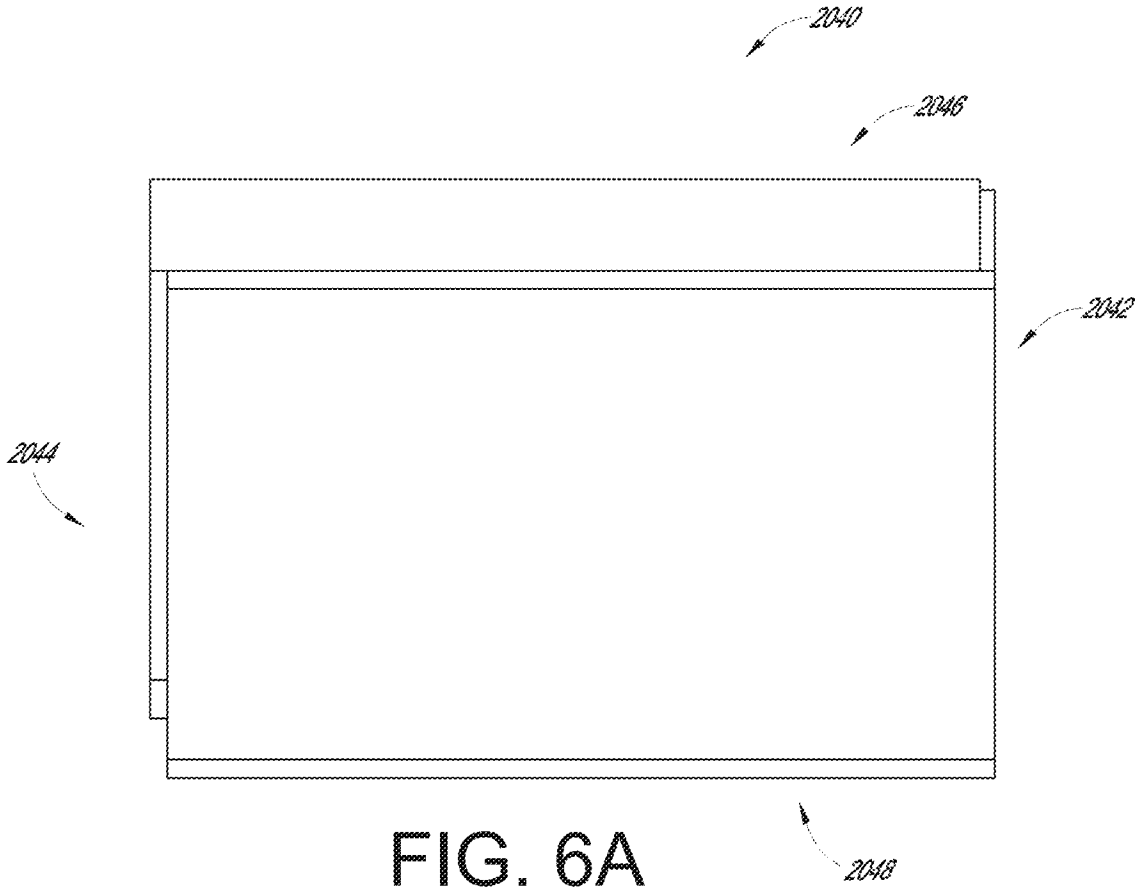
FIG. 6A is a top view of another embodiment of a cladding element.
Figure 6B:
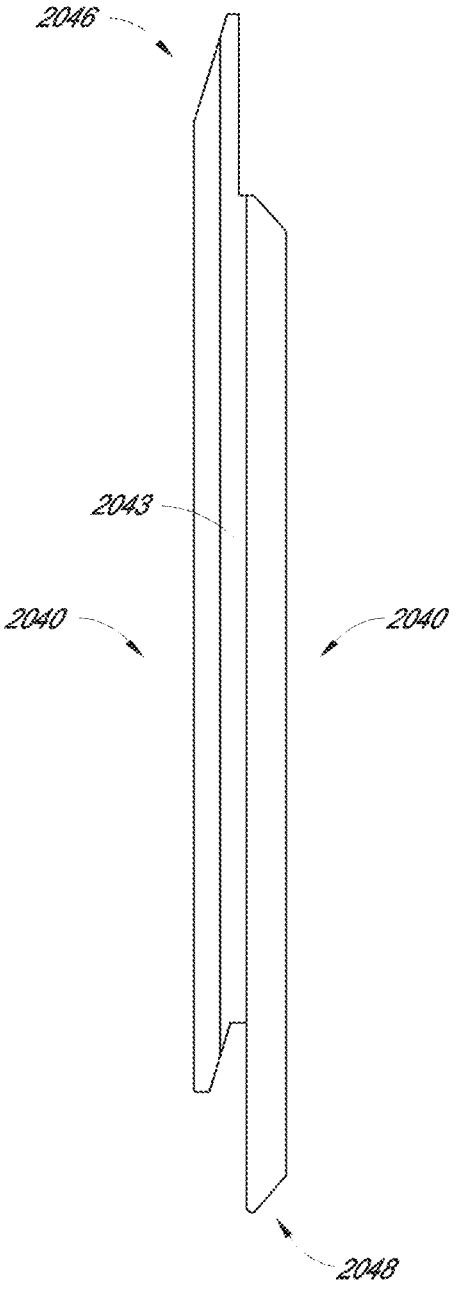
FIG. 6B is a left side view of the cladding element of FIG. 6A.
Figure 6C:
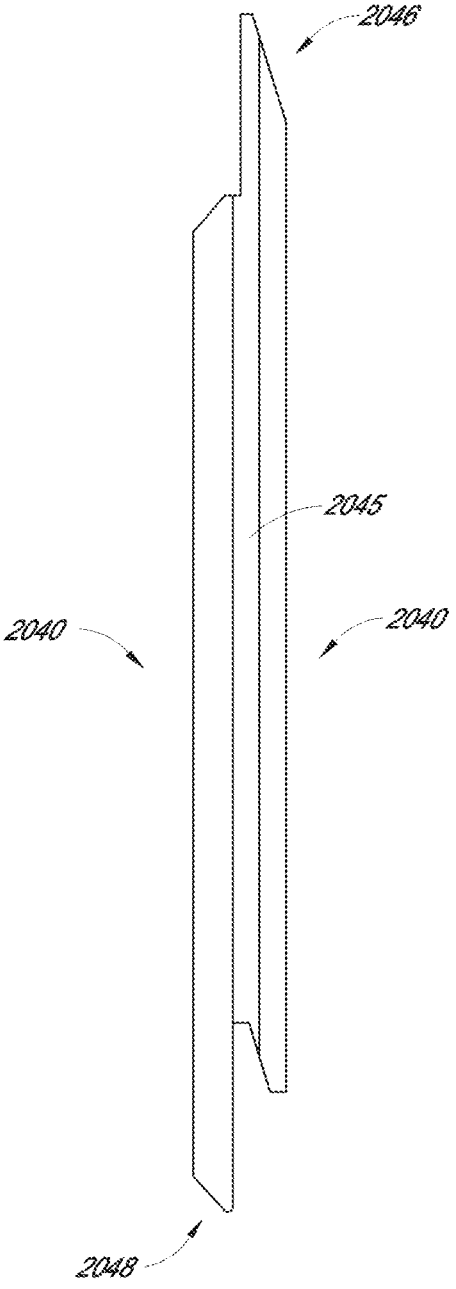
FIG. 6C is a right side view of the cladding element of FIG. 6A.
Figure 6D:
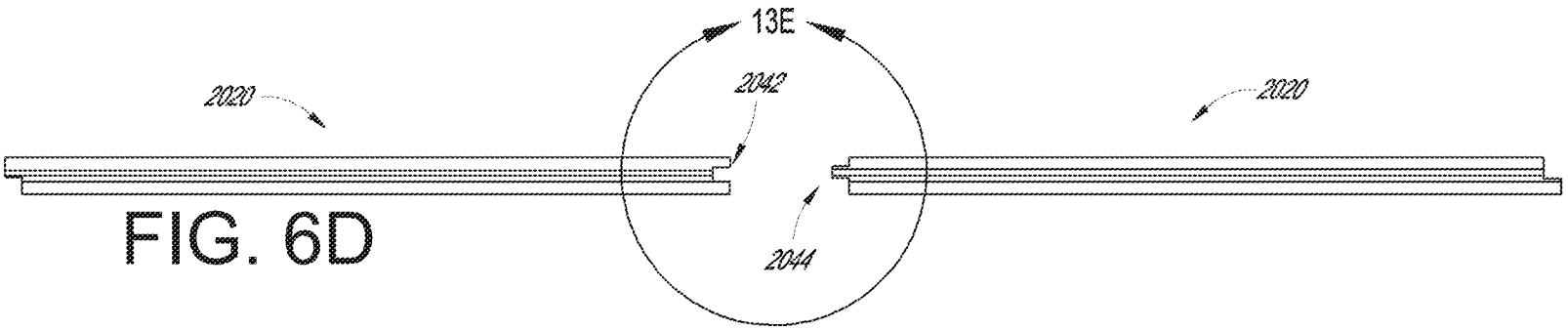
FIG. 6D is a bottom view of two cladding elements of FIG. 6A.
Figure 6E:
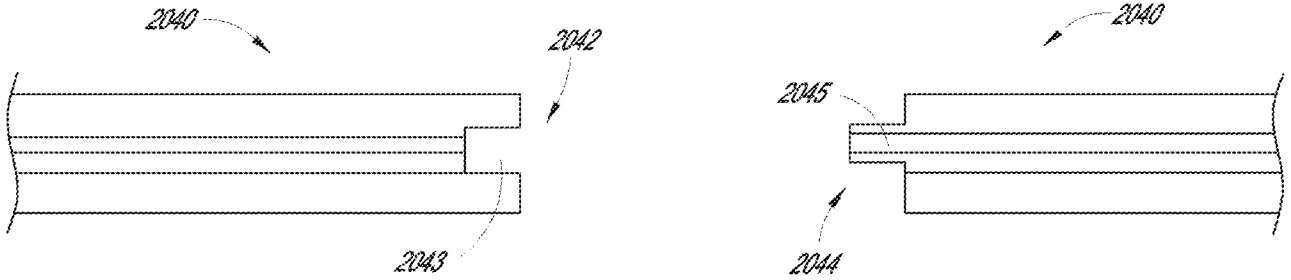
FIG. 6E is a close up bottom view of the joint edges of two cladding elements of FIG. 6A.

FIGS. 6A-6E illustrate an embodiment of a cladding element 2040 wherein some numerical references are the same as or similar to those described previously for cladding element 2000. For example, mating edges 2046, 2048 of the cladding element 2040 can the same as or similar to the mating edges 2006, 2008 of the cladding element 2000. As illustrated in FIGS. 6D-6E, the cladding element 2040 can include a joint channel 2042 on the first joint edge 2043 of the cladding element 2040. The second joint edge 2044 of the cladding element 2040 can include a joint flange 2045 configured to mate with the joint channel 2043 of an adjacent cladding element 2040. In some embodiments, one or more surfaces of the first joint edge 2043 and the second joint edge 2044 can include a channel configured to house at least a portion of a sealing element (e.g., a sealing element as described above with respect to cladding elements 2010, 2020).

FIGS. 7A-7E illustrate an embodiment of a cladding element 2060 wherein some numerical references are the same as or similar to those described previously for cladding element 2000. For example, mating edges 2066, 2068 of the cladding element 2060 can the same as or similar to the mating edges 2006, 2008 of the cladding element 2000. The angle $\alpha$3 of the joint surfaces 2063, 2065 as measured from a rear surface of the cladding element 2060 can be the same as or similar to the angle $\alpha$1 of the joint surfaces 2003, 2005 of the cladding element 2000.

Figure 7A:
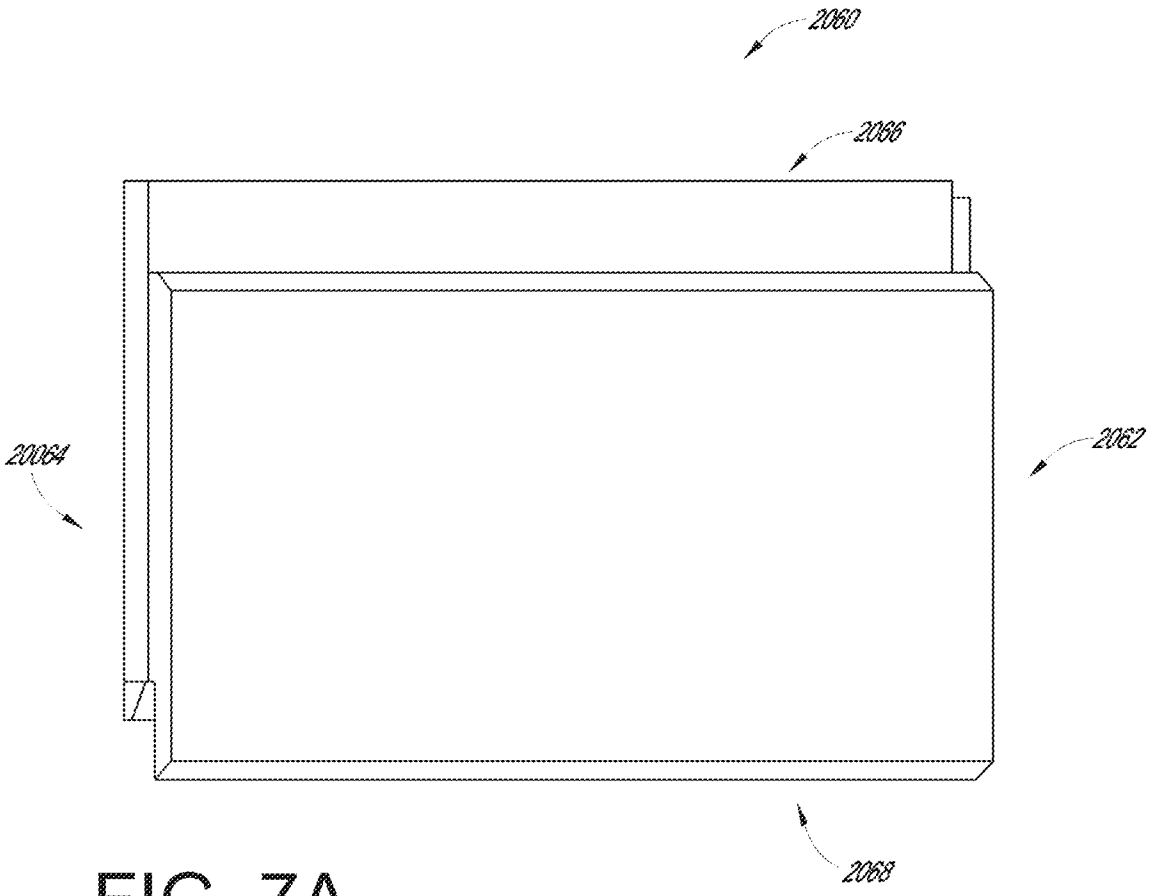
FIG. 7A is a top view of another embodiment of a cladding element.
Figure 7B:
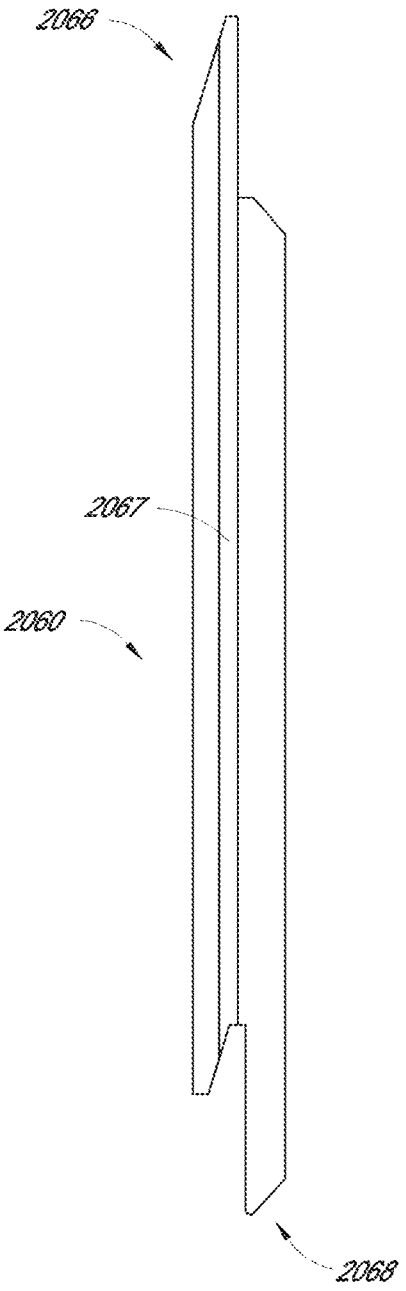
FIG. 7B is a left side view of the cladding element of FIG. 7A.
Figure 7C:
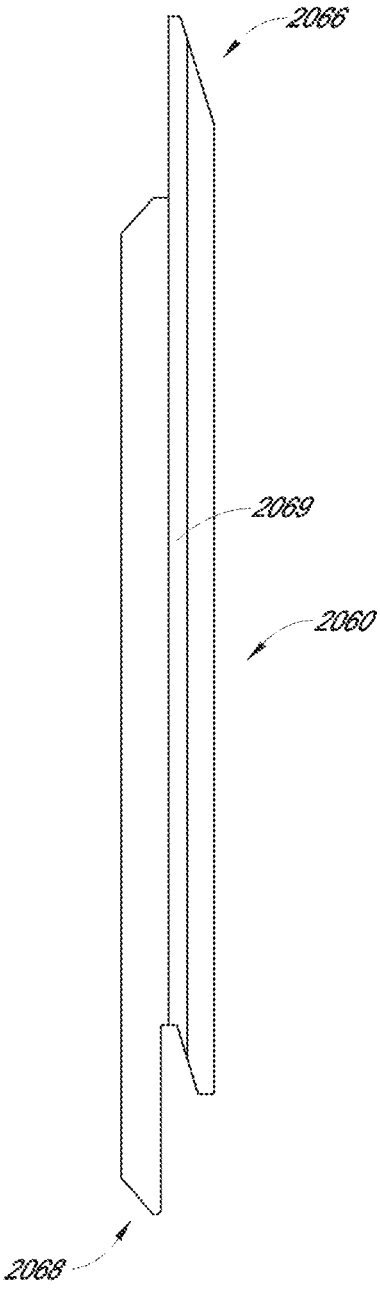
FIG. 7C is a right side view of the cladding element of FIG. 7A.
Figure 7D:
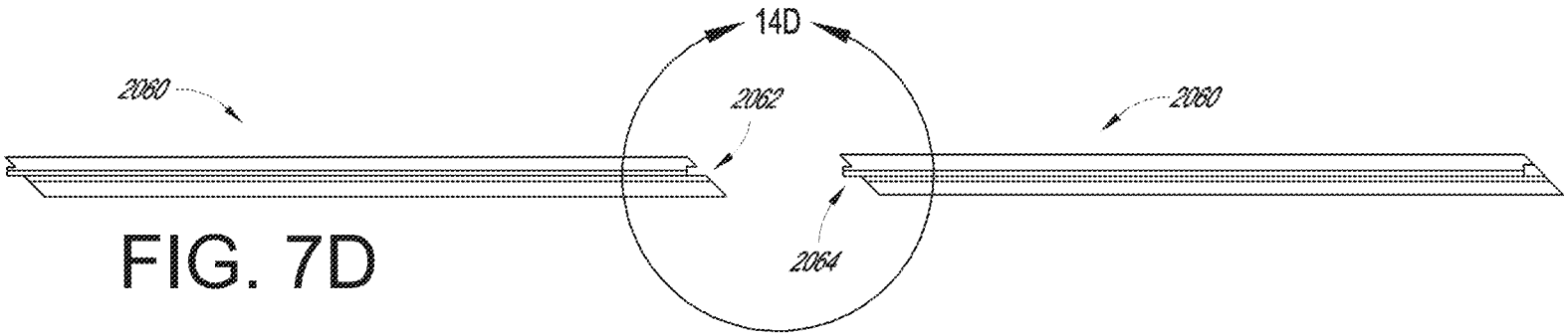
FIG. 7D is a bottom view of two cladding elements of FIG. 7A.
Figure 7E:
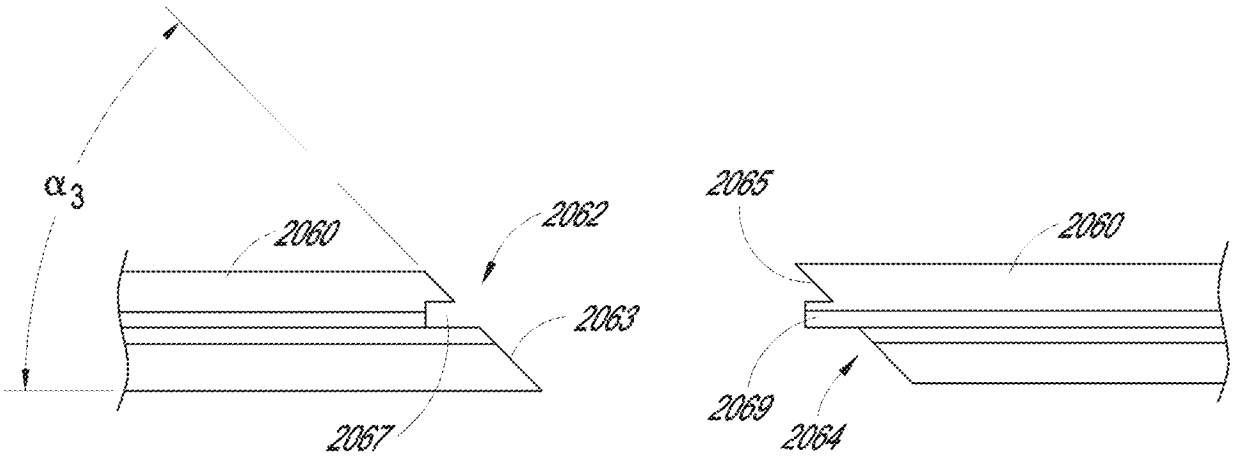
FIG. 7E is a close up bottom view of the joint edges of two cladding elements of FIG. 7A.

As illustrated in FIGS. 7C-7E, the cladding element 2060 can include a joint channel 2067 on the first joint surface 2063 of the cladding element 2060. The second joint surface 2065 of the cladding element 2060 can include a joint flange 2069 configured to mate with the joint channel 2067 of an adjacent cladding element 2060. In some embodiments, one or more surfaces of the first joint edge 2062 and the second joint edge 2064 can include a channel configured to house at least a portion of a sealing element (e.g., a sealing element as described above with respect to cladding elements 2010, 2020).

The use of joint edges (e.g., non-flat and perpendicular edges) to mate the ends of the cladding elements in a cladding system can increase the cladding system's resistance to moisture passage through the assembled cladding elements. For example, the joint edges 2043, 2045 of the cladding elements 2040 of FIGS. 6A-6E can prevent or substantially prevent most or all moisture passage through the joints 2043, 2045, with or without the use of caulk or other sealing materials. Avoiding the use of caulk or other sealing materials, while maintaining minimal or no moisture passage through the cladding system, can greatly reduce material and/or labor costs associated with cladding systems.

In some embodiments, cladding elements are advantageously arranged in a cladding system wherein a plurality of elements (e.g., any of the elements described above) are arranged such that the profiled edges of two elements are mated with each other. Additional elements can be arranged in connection with the two elements such that the joint edges of the adjacent elements in the cladding system are mated to each other. The cladding elements can be arranged in a number of different patterns, including, but not limited to, patterns in which the mating interfaces between the joint edges of pairs of elements align with each other in a direction parallel to the joint edges. In some cases, mating interfaces between joint edges of cladding elements in a respective row are offset in a direction perpendicular to the mating interfaces between the joint edges of cladding elements in adjacent rows (e.g., or columns in scenarios where the cladding elements are arranged vertically). For example, the cladding elements in a cladding system can be arranged in a stretcher bond pattern. Overlap between the respective mating interfaces (e.g., joint mating interfaces and profiled edge mating interfaces) of the adjacent cladding elements in the cladding systems can improve the overall characteristics of the system. These improved characteristics include, but are not limited to, wind resistance, water resistance, debris resistance, and/or impact resistance. For example, the interfaces between the profiled edges and the joint ends of the respective cladding elements can facilitate improved performance of the cladding system in both the vertical and horizontal directions (e.g., load and impact energy transfer between elements in both directions). Further, as discussed above, the mating interfaces between the cladding elements can increase the efficiency of constructing the cladding systems, as the interfaces can provide confirmation of alignment between the adjacent cladding elements.

Although the embodiments has been described with reference to specific examples, it will be appreciated by those skilled in the art that the disclosure may be embodied in many other forms.

It is also contemplated that various combinations or sub-combinations of the specific features and aspects of the embodiments may be made and still fall within the scope of the disclosure. Accordingly, it should be understood that various features and aspects of the disclosed embodiments can be combined with or substituted for one another in order to form varying modes of the disclosed embodiment. Thus, it is intended that the scope of the present disclosure herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A cladding element comprising:

a front face;

a rear face opposite the front face;

a first mating end having a first mating edge profile thereon;

a second mating end opposite the first mating end and having a second mating edge profile thereon;

a first joint end disposed between the first and second mating ends;

a second joint end disposed between the first and second mating ends opposite the first joint end;

a first joint feature on the first joint end, the first joint feature comprising two coplanar planar first joint surfaces separated by a semicylindrical first sealing channel, the first joint feature occupying a full thickness of the cladding element between the front face and the rear face, the first joint surfaces disposed at an acute slope angle relative to the front face;

a second joint feature on the second joint end, the second joint feature comprising two coplanar planar second joint surfaces separated by a semicylindrical second sealing channel, the first joint feature occupying the full thickness of the cladding element between the front face and the rear face, the second joint surfaces disposed at an obtuse slope angle relative to the front face; and a sealing element disposed within at least one of the first and second sealing channels;

wherein the first mating edge profile and the second mating edge profile are differently shaped relative to the first joint feature and the second joint feature.

2. The cladding element of claim 1, wherein the sealing element is an elastomeric rod.

3. The cladding element of claim 1, wherein the first sealing channel extends along an entire length of the first joint end.

4. The cladding element of claim 1, wherein the first joint surface is positioned at an offset angle from the rear face of the cladding element.

5. The cladding element of claim 4, wherein the offset angle is between 35 degrees and 55 degrees.

6. The cladding element of claim 1, wherein the first sealing channel extends through a first mating feature on the first mating end of the cladding element and through a second mating feature on the second mating end of the cladding element.

7. The cladding element of claim 1, wherein the first sealing channel and the second sealing channel have semicircular profiles.

8. The cladding element of claim 7, wherein the sealing element is a cylindrical elastomeric rod.

9. The cladding element of claim 1, wherein the first mating end comprises a first mating profile, and wherein the second mating end comprises a second mating profile complementary to the first mating profile.

* * * * *